US007178893B2

(12) United States Patent
Noda

(10) Patent No.: US 7,178,893 B2
(45) Date of Patent: Feb. 20, 2007

(54) HEAD CONTROLLER, INKJET RECORDING APPARATUS, AND IMAGE RECORDING APPARATUS THAT PREVENT DEGRADATION IN IMAGE QUALITY DUE TO ENVIRONMENTAL TEMPERATURE CHANGES

(75) Inventor: Hiroshi Noda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 80 days.

(21) Appl. No.: 10/519,876

(22) PCT Filed: Jun. 24, 2003

(86) PCT No.: PCT/JP03/07992

§ 371 (c)(1),
(2), (4) Date: Dec. 30, 2004

(87) PCT Pub. No.: WO2004/007205
PCT Pub. Date: Jan. 22, 2004

(65) Prior Publication Data

US 2005/0270318 A1 Dec. 8, 2005

(30) Foreign Application Priority Data

Jul. 16, 2002 (JP) ..... 2002-206377

(51) Int. Cl.
*B41J 29/38* (2006.01)
*B41J 2/45* (2006.01)

(52) U.S. Cl. ..... 347/10; 347/17; 347/68

(58) Field of Classification Search ..... 347/10
See application file for complete search history.

(56) References Cited

U.S. PATENT DOCUMENTS 6,203,132 B1 * 3/2001 Tsukada et al. ..... 347/11
6,312,076 B1 * 11/2001 Taki et al. ..... 347/10
6,431,676 B2 * 8/2002 Asauchi et al. ..... 347/10
6,467,865 B1 * 10/2002 Iwamura et al. ..... 347/14
6,502,914 B2 * 1/2003 Hosono et al. ..... 347/11
6,820,955 B1 * 11/2004 Usui ..... 347/7

FOREIGN PATENT DOCUMENTS

| | | |
|---|---|---|
| JP | 61-59911 | 3/1986 |
| JP | 2-51734 | 2/1990 |
| JP | 6-71882 | 3/1994 |
| JP | 11-20164 | 1/1999 |
| JP | 11-268266 | 10/1999 |
| JP | 2001-205798 | 7/2001 |
| JP | 2002-240273 | 8/2002 |

* cited by examiner

*Primary Examiner*—Vip Patel
*Assistant Examiner*—Shelby Fidler
(74) *Attorney, Agent, or Firm*—Cooper & Dunham LLP

(57) ABSTRACT

A head controller controls pressure creating means for contracting and expanding the volume of a pressurizing compartment communicating with a nozzle of a droplet discharging head. Drive waveform generating means outputs a drive pulse including a first waveform element expanding the compartment, a second waveform element maintaining the expanded state of the compartment, and a third waveform element contracting the compartment so that droplets are discharged. When a first potential difference is a potential difference between the first waveform element at the beginning of the expansion and the second waveform element, and the second potential difference is a potential difference between the third waveform element at the end of the contraction and the second waveform element, the difference between the first and second potential differences is decreased when environmental temperature is higher than a first predetermined temperature, and increased when the temperature is lower than a second predetermined temperature.

6 Claims, 11 Drawing Sheets

HEAD CONTROLLER, INKJET RECORDING APPARATUS, AND IMAGE RECORDING APPARATUS THAT PREVENT DEGRADATION IN IMAGE QUALITY DUE TO ENVIRONMENTAL TEMPERATURE CHANGES

TECHNICAL FIELD

The present invention relates to head controllers and image recording apparatuses.

BACKGROUND ART

Inkjet recording apparatuses used as image recording apparatuses (image forming apparatuses), such as printers, facsimile apparatuses, copying apparatuses, and plotters, are equipped with an inkjet head as a droplet discharging head that includes: a nozzle for discharging ink drops; an ink channel (also referred to as a discharge compartment, pressure compartment, pressurizing compartment, liquid compartment, and so on) communicating with the nozzle; and pressure creating means for pressurizing ink in the ink channel. Droplet discharging heads also include, for example, a droplet discharging head that discharges a liquid resist in the form of droplets, and a droplet discharging head that discharges a sample of DNA in the form of droplets. In the following, however, a description will be given with focus on the inkjet head.

Inkjet heads such as the so-called piezo inkjet, the so-called thermal inkjet head, and an electrostatic inkjet head are known. The piezo inkjet deforms a vibrating plate that forms a wall surface of an ink channel by using a piezoelectric element as the pressure creating means for pressurizing ink in the ink channel, and varies the volume of the ink channel so as to discharge ink drops (refer to Japanese Laid-Open Patent Application No. 2-51734). The thermal inkjet head discharges ink drops with pressure that is created by generating bubbles through heating ink in the ink channel by using a heat resistive element (refer to Japanese Laid-Open Patent Application No. 61-59911). In the electrostatic inkjet head, the vibrating plate forming the wall surface of the ink channel and an electrode are arranged in a mutually opposing manner, and the vibrating plate is deformed by an electrostatic energy generated between the vibrating plate and the electrode, thereby varying the volume of the ink channel so as to discharge ink drops (refer to Japanese Laid-Open Patent Application No. 6-71882).

Some of such inkjet heads are driven by a push discharging method whereby ink drops are discharged by pushing the vibrating plate toward the pressurizing compartment so as to decrease the volume of the pressurizing compartment. In addition, some inkjet heads are driven by a pull discharging method whereby ink drops are discharged by deforming the vibrating plate with a force directed toward the outside of an ink compartment so as to increase the volume of the ink compartment and then bringing the vibrating plate to the original state so that the ink compartment is returned to its original volume.

Additionally, regarding the inkjet heads, the viscosity of ink is varied in accordance with temperature changes in different environments, which leads to speeding up or reducing of the speed (ink drop discharging speed) Vj of ink drops. Thus, the impact positions of ink drops on a recording paper may be shifted, and the volume (ink drop discharging volume) Mj of an ink drop may be increased or decreased. Consequently, the intensity of an image may be changed or image quality may be changed. Further, since the ink drop discharging speed Vj is increased and decreased, in some cases, injection bending occurs, and injection down accompanying the spray bending occurs.

Therefore, as described in Japanese Laid-Open Patent Application No. 11-268266, for example, as for a driving method of the piezo type head of the pull discharging type, taking environmental temperature changes into consideration, as shown in FIG. 1, a method is known in which a first signal P1 expands a pressure creation compartment, a second signal P2 maintains an expanded state of the pressure creation compartment, and a third signal P3 discharges ink drops by contracting the pressure creation compartment in the expanded state. Based on a temperature detection result of temperature detecting means, when the temperature is high, the difference between a first potential difference ΔV1 (that is, the potential difference between the first signal P1 and the second signal P2) and a second potential difference ΔV2 (that is, the potential difference between the third signal P3 and the second signal P2) is widened (increased). When the temperature is low, the difference between the first potential difference ΔV1 and the second potential difference ΔV2 is narrowed (decreased).

In other words, when the temperature is high, the potential of the first signal P1 and the potential of the third signal P3 are decreased as indicated by the broken lines in FIG. 1. On this occasion, by making the decreasing amount of the third signal P3 greater than that of the first signal P1, the difference between the first potential difference ΔV1 and the second potential difference ΔV2 is widened. On the other hand, when the temperature is low, the potential of the first signal P1 and the potential of the third signal P3 are increased as indicated by the two-dot chain line and the chain line in FIG. 1, respectively. At this point, by making the increasing amount of the third signal P3 greater than that of the first signal P1, the difference between the first potential difference ΔV1 and the second potential difference ΔV2 is narrowed.

However, in the conventional inkjet head driving method described above, when the temperature is high, the difference between the first potential difference ΔV1 and the second potential difference ΔV2 is increased, and when the temperature is low, the difference between the first potential difference ΔV1 and the second potential difference ΔV2 is decreased. Thus, when the temperature is low, the pressure creation compartment is contracted in a state where the meniscus is less pulled back than it is in ordinary temperature. Even if meniscus is pulled back, the pressure creation compartment is excessively contracted. Accordingly, the discharging volume Mj of an ink drop is increased.

That is, since the ink viscosity is varied in accordance with temperature, the ink drop discharging speed Vj is increased at high temperatures, while the ink drop discharging speed Vj is decreased at low temperatures. As indicated by the continuous lines in FIG. 2, however, the ink drop discharging volume Mj is increased both at high temperatures and low temperatures.

Here, if the difference between the first potential difference ΔV1 and the second potential difference ΔV2 is decreased, when the temperature is low, the pressure creation compartment is contracted in a state where the meniscus of the nozzle is less pulled back than it is at ordinary temperature. Even if the meniscus is pulled back, the pressure creation compartment is excessively contracted. Hence, the ink drop discharging volume Mj is increased as indicated by the two-dot chain line in FIG. 2.

As described above, in the conventional inkjet head driving method, there is a problem in that the ink drop discharging speed Vj and the ink drop discharging volume Mj are varied in accordance with temperature changes, resulting in degradation of image quality.

DISCLOSURE OF THE INVENTION

It is a general object of the present invention to provide an improved and useful head controller, inkjet recording apparatus, and image recording apparatus in which the above-mentioned problems are solved.

A more specific object of the present invention is to provide a head controller, ink jet recording apparatus, and image recording apparatus that prevent image quality degradation due to environmental temperature changes.

In order to achieve the above-mentioned objects, according to one aspect of the present invention, there is provided a head controller for controlling pressure creating means for contracting and expanding a volume of a pressurizing compartment communicating with a nozzle of a droplet discharging head, including:

drive waveform generating means for outputting a drive pulse that includes at least a first waveform element for expanding the volume of the pressurizing compartment, a second waveform element for maintaining an expanded state of the volume of the pressurizing compartment caused by the first waveform element, and a third waveform element for contracting the volume of the pressurizing compartment in the expanded state so that droplets are discharged from the pressurizing compartment; and means for decreasing a difference between first and second potential differences when environmental temperature is higher than a first predetermined temperature and increasing the difference between the first and second potential differences when the environmental temperature is lower than a second predetermined temperature, the first potential difference being a potential difference between the first waveform element at the beginning of expansion of the volume of the pressurizing compartment and the second waveform element, and the second potential difference being a potential difference between the third waveform element at the end of contraction of the volume of the pressurizing compartment and the second waveform element.

In the head controller according to the present invention, when the first potential difference is greater than the second potential difference, it is preferable that the potential of the first waveform element be varied. In addition, when the second potential difference is greater than the first potential difference, it is preferable that the potential of the third waveform element be varied.

Additionally, according to another aspect of the present invention, there is provided an inkjet recording apparatus that includes:

a droplet discharging head for discharging ink drops and having a pressurizing compartment;

drive waveform generating means for outputting a drive pulse that includes at least a first waveform element for expanding a volume of the pressurizing compartment of the droplet discharging head, a second waveform element for maintaining an expanded state of the volume of the pressurizing compartment caused by the first waveform element, and a third waveform element for contracting the volume of the pressurizing compartment in the expanded state so that ink drops are discharged from the pressurizing compartment;

temperature detecting means for detecting environmental temperature; and means for decreasing a difference between first and second potential differences when the environmental temperature is higher than a first predetermined temperature and increasing the difference between the first and second potential differences when the environmental temperature is lower than a second predetermined temperature, the first potential difference being a potential difference between the first waveform element at the beginning of expansion of the volume of the pressurizing compartment and the second waveform element, and the second potential difference being a potential difference between the third waveform element at the end of contraction of the volume of the pressurizing compartment and the second waveform element.

In the inkjet recording apparatus according to the present invention, when the first potential difference is greater than the second potential difference, it is preferable that the potential of the first waveform element be varied. In addition, when the second potential difference is greater than the first potential difference, it is preferable that the potential of the third waveform element be varied.

Further, according to another aspect of the present invention, there is provided a recording apparatus that includes:

a droplet discharging head for discharging droplets and having a pressurizing compartment;

drive waveform generating means for outputting a drive pulse that includes at least a first waveform element for expanding a volume of the pressurizing compartment of the droplet discharging head, a second waveform element for maintaining an expanded state of the volume of the pressurizing compartment caused by the first waveform element, and a third waveform element for contracting the volume of the pressurizing compartment in the expanded state so that droplets are discharged from the pressurizing compartment;

temperature detecting means for detecting environmental temperature; and means for decreasing a difference between first and second potential differences when the environmental temperature is higher than a first predetermined temperature and increasing the difference between the first and second potential differences when the environmental temperature is lower than a second predetermined temperature, the first potential difference being a potential difference between the first waveform element at the beginning of expansion of the volume of the pressurizing compartment and the second waveform element, and the second potential difference being a potential difference between the third waveform element at the end of contraction of the volume of the pressurizing compartment and the second waveform element.

In the recording apparatus according to the present invention, when the first potential difference is greater than the second potential difference, it is preferable that the potential of the first waveform element be varied. In addition, when the second potential difference is greater than the first potential difference, it is preferable that the potential of the third waveform element be varied.

As described above, with the head controller according to the present invention, when it is assumed that the potential difference between the first waveform element at the beginning of the expansion of the volume of the pressurizing compartment and the second waveform is the first potential difference, and the potential difference between the third waveform element at the end of the contraction of the volume of the pressurizing compartment and the second waveform element is the second potential difference, if environmental temperature is higher than the first predetermined temperature, the difference between the first and second potential differences is decreased. On the other hand, when environmental temperature is lower than the second predetermined temperature, the difference between the first and second potential differences is increased. Hence, it is possible to appropriately correct the drop speed and the drop volume with respect to temperature changes. Thus, it is possible to improve image quality.

Additionally, with the image recording apparatus according to the present invention, when it is assumed that the potential difference between the first waveform element at the beginning of the expansion of the volume of the pressurizing compartment and the second waveform is the first potential difference, and the potential difference between the third waveform element at the end of the contraction of the volume of the pressurizing compartment and the second waveform element is the second potential difference, if environmental temperature is higher than the first predetermined temperature, the difference between the first and second potential differences is decreased. On the other hand, when environmental temperature is lower than the second predetermined temperature, the difference between the first and second potential differences is increased. Hence, it is possible to appropriately correct the drop speed and the drop volume with respect to temperature changes. Thus, it is possible to improve image quality.

Other objects, features and advantages of the present invention will become more apparent from the following detailed description when read in conjunction with the drawings.

BEST MODE FOR CARRYING OUT THE INVENTION

Figure 1:
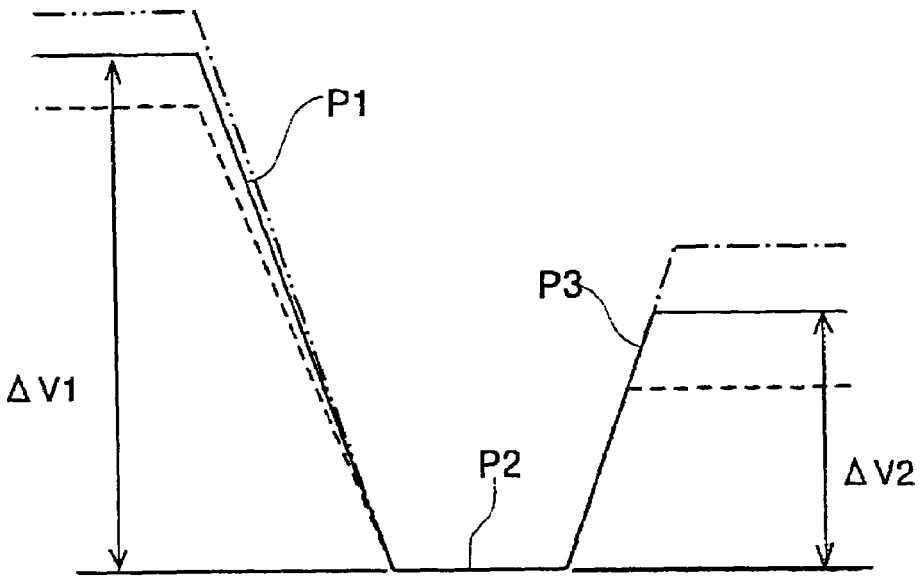
FIG.1 PRIOR ART
FIG. 1 is a graph of a drive waveform for explaining a conventional head controller.
Figure 2:
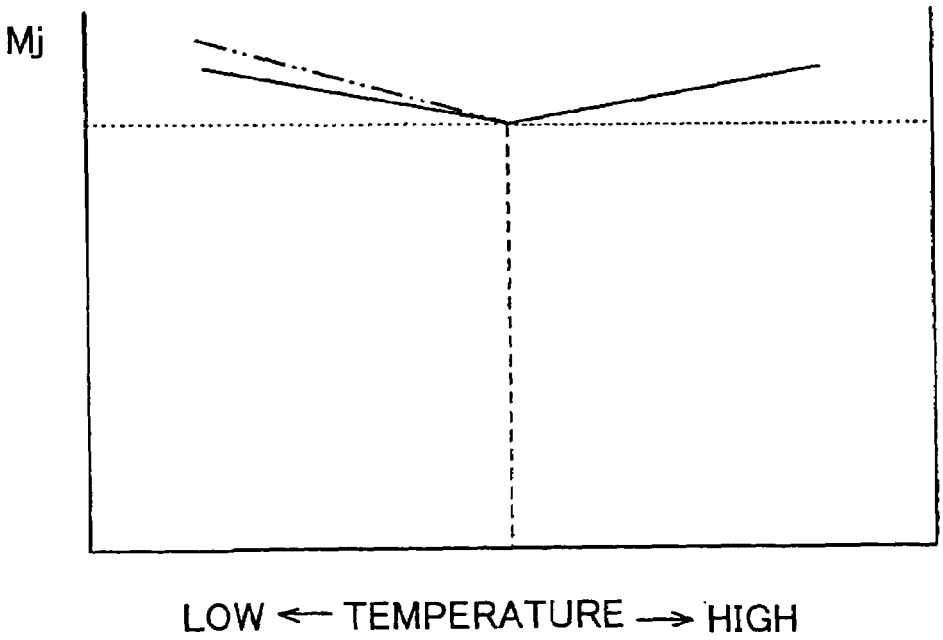
FIG.2 PRIOR ART
FIG. 2 is a graph for explaining variation in an ink drop discharging volume Mj with respect to temperature changes in the conventional head controller.
Figure 3:
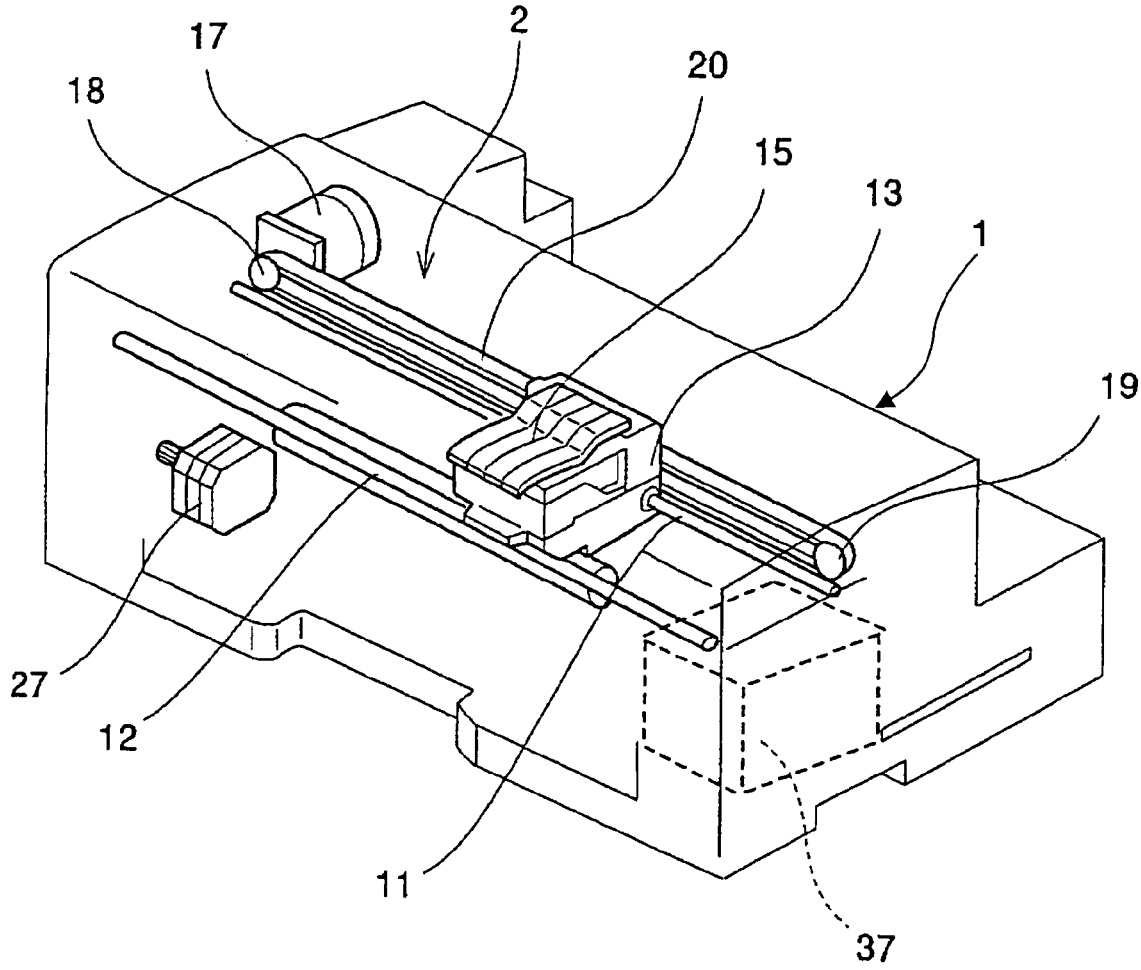
FIG. 3 is a perspective view showing an example of a mechanism part of an inkjet recording apparatus as an image recording apparatus according to the present invention.
Figure 4:
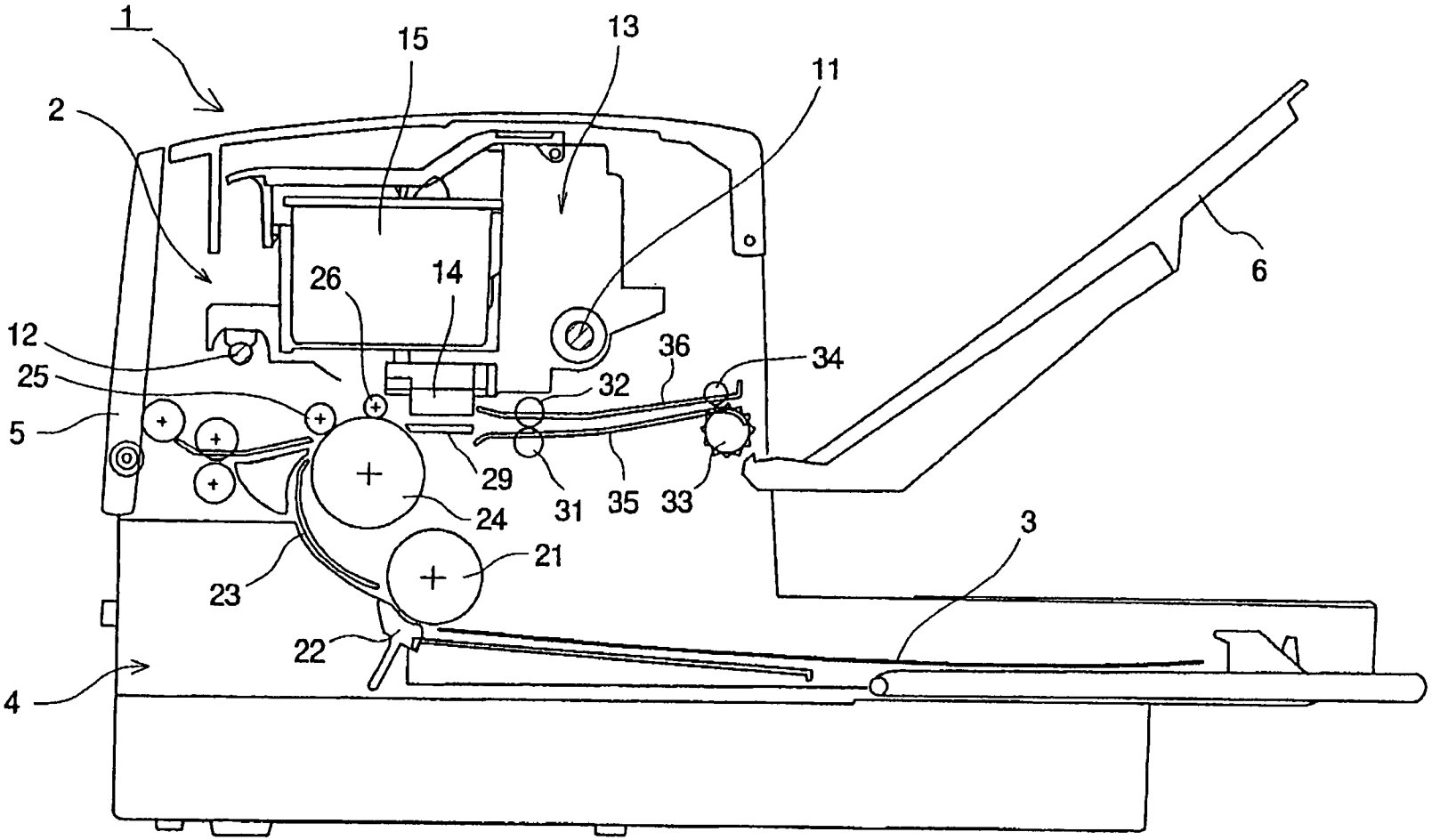
FIG. 4 is a cross-sectional view of the mechanism part of the inkjet recording apparatus.

A description will now be given of preferred embodiments of the present invention, with reference to the accompanying drawings. FIG. 3 is a schematic perspective view of a mechanism part of an inkjet recording apparatus as an image recording apparatus according to the present invention. FIG. 4 is a cross-sectional view of the working part.

The ink jet recording apparatus houses, inside a recording apparatus body 1, a printing mechanism part 2 constructed by a carriage that can move in a main scanning direction, recording heads formed by inkjet heads mounted on the carriage, an ink cartridge that supplies ink to the recording head, for example. The inkjet recording apparatus brings in a sheet of paper 3 that is fed from a paper feed cassette 4 or a manual paper feed tray 5, records a desired image by the printing mechanism part 2, and thereafter delivers the paper to a paper deliver tray 6 that is attached to the rear face of the recording apparatus body 1.

The printing mechanism part 2 holds a carriage 13 in a slidable manner in the main scanning direction (in the perpendicular direction to FIG. 4) by a main guide rod 11 and a sub-guide rod 12 that are guide members laid on sideboards (not shown) on the right and left. Heads (also referred to herein as inkjet heads and recording heads) 14 discharge ink drops of yellow (Y), cyan (C), magenta (M), and black (Bk), respectively, and are attached to the carriage 13 with the ink drop discharging direction down. Ink tanks (ink cartridges) 15 of the respective colors for supplying inks of the respective colors are attached to the upper side of the carriage 13 in an exchangeable manner.

The ink cartridges 15 each include an air hole in the upper side thereof that communicates with the atmosphere, a supply port in the bottom side thereof that supplies an ink to the corresponding inkjet head 14, and a porous body provided therein that is filled with the ink. Inks supplied to the inkjet heads 14 are maintained under slight negative pressure by capillary force of the porous body. The inks are supplied from the ink cartridges 15 to inside the heads 14.

The back side (the downstream side of a paper conveying direction) of the carriage 13 is fit to the main guide rod 11 in a slidable manner, and the front side (the upstream side of the paper conveying direction) of the carriage 13 is disposed on the sub-guide rod 12 in a slidable manner. In order to move the carriage 13 and scan in the main scanning direction, a timing belt 20 is stretched between a driving pulley 18 rotated by a main scanning motor 17 and a sub-driving pulley 19, the timing belt 20 is fixed to the carriage 13, and the carriage 13 is driven in a reciprocating manner by the rotation and reverse rotation of the main scanning motor 17.

Additionally, in the case above, the heads 14 of the respective colors are used as recording heads. However, one head having nozzles that discharge ink drops of the respective colors may be used instead. Further, regarding the heads 14, a vibrating plate forming at least a part of the wall surface of an ink channel and a piezo type inkjet head deforming the vibrating plate by a piezoelectric element are used as is described below.

In order to convey the sheet of paper 3 that is set to the paper feed cassette 4 to the underneath of the inkjet heads 14, there are provided a paper feed roller 21 that separates and feeds the sheet of paper 3 from the paper feed cassette 4, a friction pad 22, a guide member 23 that guides the sheet of paper 3, a convey roller 24 that inverts and conveys the fed sheet of paper 3, a convey roller 25 that is pressed against the surface of the convey roller 24, and a front roller 26 that defines the feeding angle of the sheet of paper 3 from the convey roller 24. The convey roller 24 is rotated by a sub-scanning motor 27 via a suitable gear train.

Additionally, there is provided a receiving member 29 as a paper guide member that guides, under the recording heads 14, the sheet of paper 3 conveyed from the convey roller 24 in accordance with the moving range of the carriage 13 in the main scanning direction. On the downstream side of the paper conveying direction after the receiving member 29, there are provided a convey roller 31 and a spur 32 that are rotated for conveying the sheet of paper 3 in the delivering direction. Further, a paper deliver roller 33 and a spur 34 that convey the sheet of paper 3 to the paper deliver tray 6, and guide members 35 and 36 that form a paper delivery channel are arranged as illustrated.

In recording, by driving the recording heads 14 in accordance with image signals while moving the carriage 13, inks are discharged onto the sheet of paper 3 that is stopped, and thus recording is performed for one line. The recording of the following line is performed after the sheet of paper 3 is conveyed for a predetermined amount. The recording operation ends and the sheet of paper 3 is delivered by receiving a recording end signal or a signal indicating that the end of the sheet of paper 3 reaches a recording area.

Further, a recovery device 37 (FIG. 3) for recovering inadequate discharging of the heads 14 is arranged at a position outside the recording area on the right end side of the moving direction of the carriage 13. The recovery device 37 includes cap means, suction means, and cleaning means. During suspension of printing, the carriage 13 is moved to the recovery device 37 side, and capping is performed on the heads 14 by the cap means, thereby maintaining discharging hole parts (nozzle holes) in a wet condition so as to prevent inadequate discharging due to drying of inks. Also, by discharging (purging) inks not relating to recording in such as the middle of recording, the ink viscosity at all of the discharging holes are maintained to be constant, thereby maintaining stable discharging performance.

In cases where, for example, inadequate discharging occurs, the discharging holes (nozzles) of the heads 14 are sealed by the cap means, air bubbles and the like as well as inks are pumped out of the discharging holes by suction means via a tube, and ink, dust, and the like adhering to the surfaces of the discharging holes are removed by the cleaning means. Thus, inadequate discharging is recovered. In addition, the pumped inks are exhausted to a waste ink reservoir (not shown) provided in the lower part of the recording apparatus body 1 and absorbed and retained by an ink absorber in the waste ink reservoir.

Figure 5:
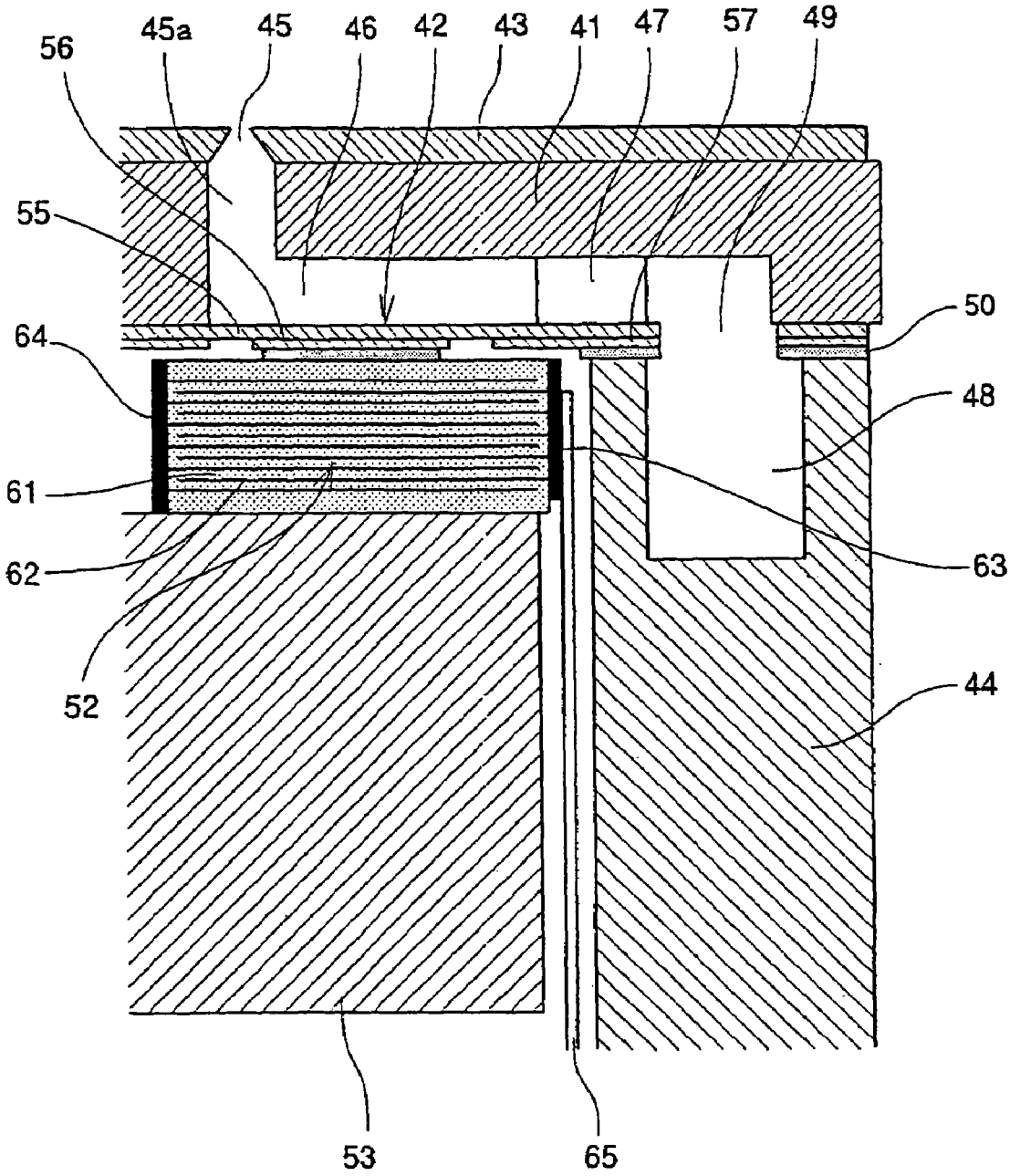
FIG. 5 is a cross-sectional view for explaining an example of inkjet heads constructing recording heads of the inkjet recording apparatus, taken along the longitudinal direction of a liquid compartment of the heads.
Figure 6:
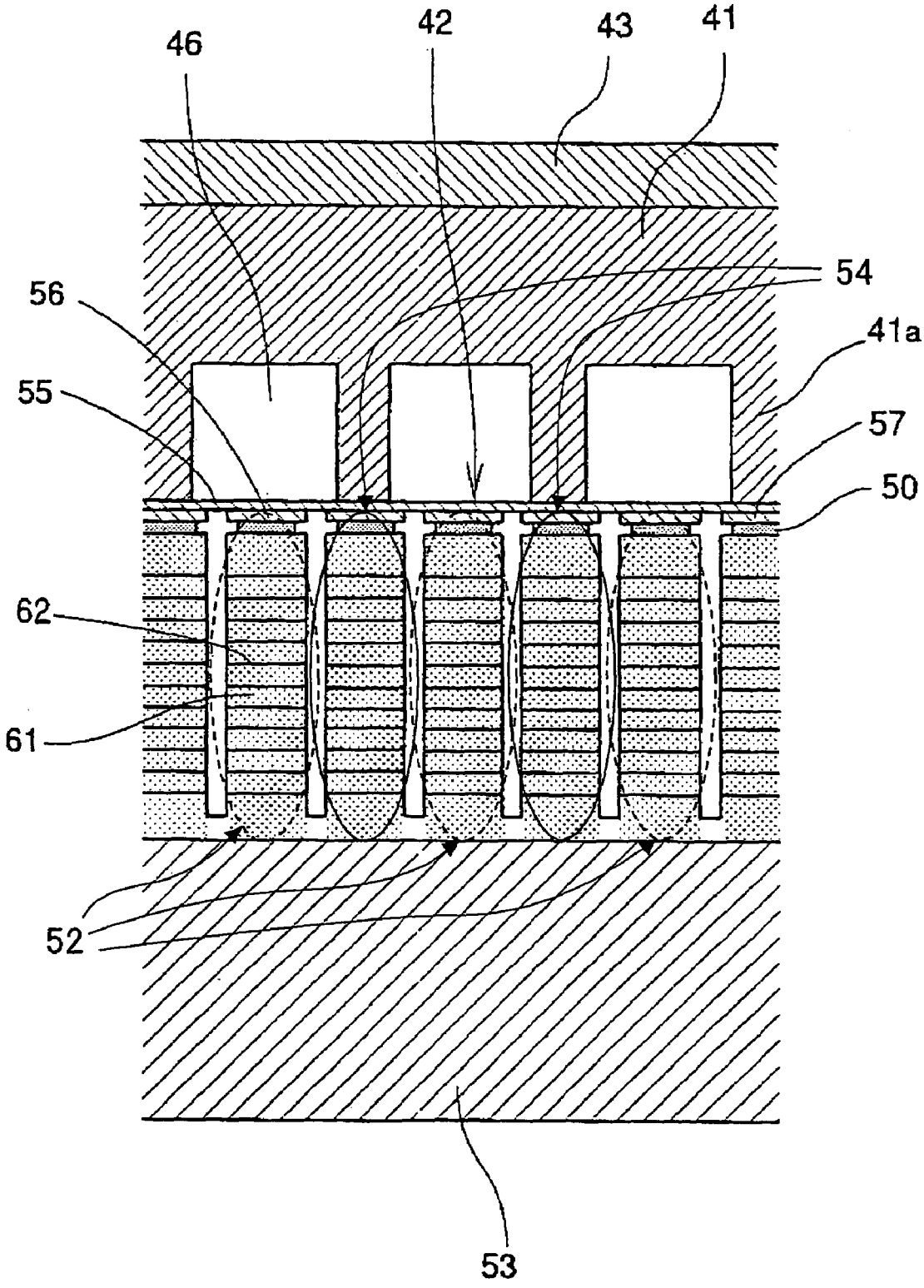
FIG. 6 is a cross-sectional view taken along the width direction of the liquid compartment of the heads.
Figure 7:
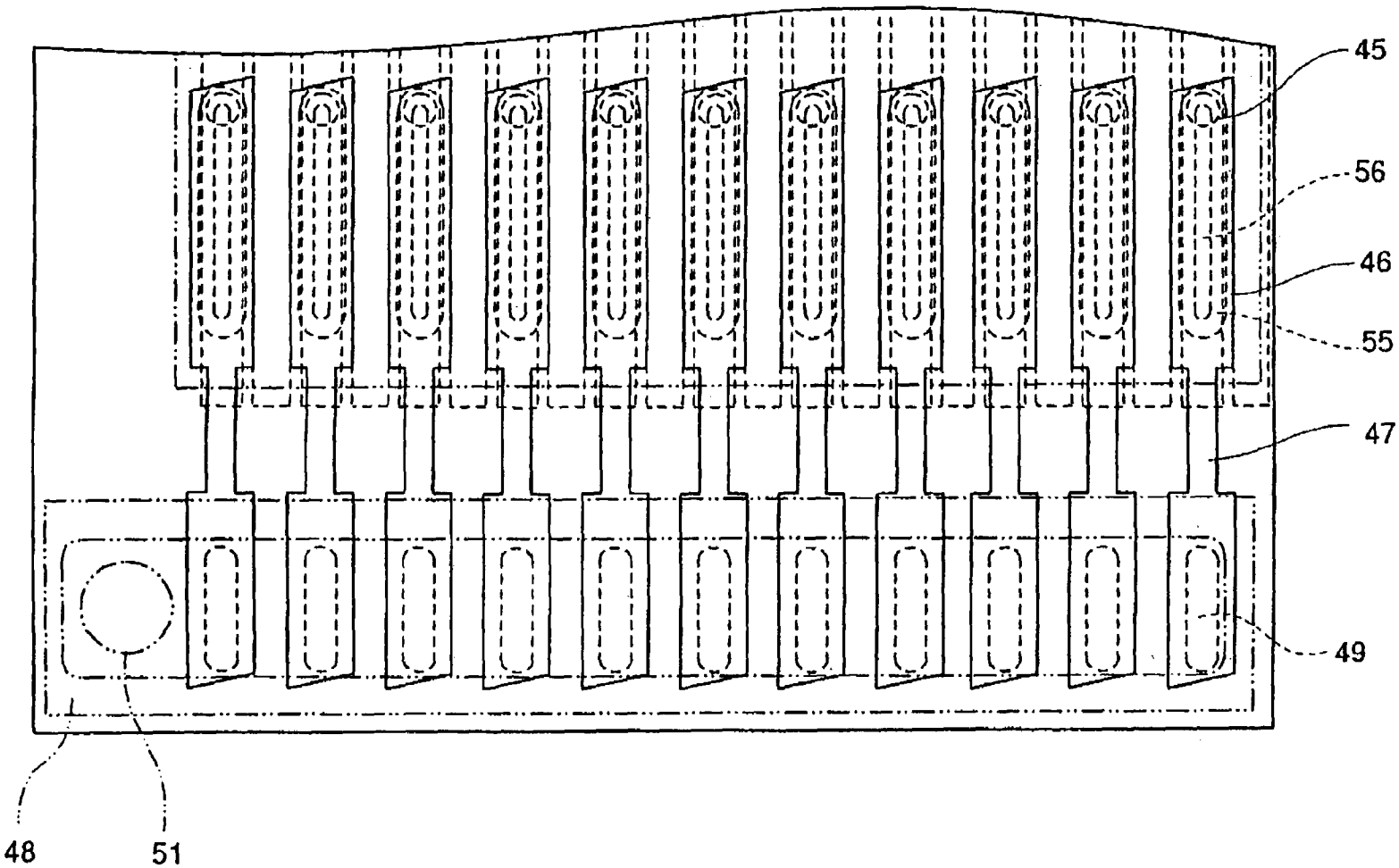
FIG. 7 is a plan view for explaining a part of the heads.

Next, by referring to FIGS. 5 through 7, a description will be given of the inkjet heads forming the recording heads 14 of the inkjet recording apparatus. FIG. 5 is a cross-sectional view taken along the longitudinal direction of a liquid compartment of the recording heads 14. FIG. 6 is a cross-sectional view taken along the width direction of the liquid compartment of the recording heads 14. FIG. 7 is a plan view of a part of the recording heads 14.

The inkjet heads include a channel plate 41 formed by a single-crystal silicon board, a vibrating plate 42 bonded to the undersurface of the channel plate 41, and a nozzle plate 43 bonded to the top surface of the channel plate 41, which form pressurizing compartments 46 and ink supply channels 47. The pressurizing compartment 46 is an ink channel with which a nozzle 45 discharging ink drops, which are droplets, communicates via a nozzle communicating channel 45*a*. The ink supply channel 47 serves as a fluid resistor that communicates with, via an ink supply opening 49, a common liquid compartment 48 for supplying ink to the pressurizing compartment 46.

A laminated type piezoelectric element 52 as an electromechanical converting element that is pressure creating means (actuator means) for pressurizing inks in the pressurizing compartments 46 is bonded to the outer surface (surface opposite to the liquid compartment) of the vibrating plate 42 so as to correspond to each pressurizing compartment 46. The piezoelectric element 52 is bonded to a base board 53. Additionally, bracing parts 54 are provided such that each of the bracing parts 54 is interposed between the piezoelectric elements 52 so as to correspond to a dividing wall 41*a* between the pressurizing compartments 46 provided over the piezoelectric elements 52 (FIG. 6). Here, slit processing by half-cut dicing is performed on the piezoelectric element member so as to divide the piezoelectric element member into teeth of a comb-like shape, and the piezoelectric elements 52 and the bracing parts 54 are arranged alternately. The structure of the bracing part 54 is the same as that of the piezoelectric element 52. However, the bracing parts 54 merely serves as braces since a driving voltage is not applied thereto.

Further, the periphery part of the vibrating plate 42 is bonded to a frame member 44 by an adhesive 50 including a gap member. A concave portion serving as the common liquid compartment 48 and an ink supply hole 51 (refer to FIG. 7) for externally supplying inks to the common liquid compartment 48 are formed in the frame member 44. The frame member 44 is formed by, for example, injection molding using epoxy resin or polyphenylene sulphite.

Here, the concave portions and the holes serving as the nozzle communicating channels 45*a*, the pressurizing compartments 46, and the ink supply channels 47 are formed in the channel plate 41 by performing anisotropic etching using an alkaline etchant, such as potassium hyndroxide water solution (KOH), on a single-crystal silicon board of crystal face direction (110), for example. However, the single-crystal silicon is not a limitation. A stainless board, a photosensitive polymer, for example, may also be used.

The vibrating plate 42 is formed by a metal plate made of nickel, which is manufactured by an electroforming method, for example. However, other metal plates, resins, and joint members of metals and resin plates may also be used. The vibrating plate 42 forms, in corresponding relation to the pressurizing compartments 46, thin-walled parts (diaphragm parts) 55 for facilitating deformation and thick-walled parts (island shaped protrusions) for bonding to the piezoelectric element 52. The vibrating plate 42 also forms thick-walled parts 57 in corresponding relation to the bracing parts 54 and junctions of the frame member 44. The flat surface side of the vibrating plate 42 is bonded to the channel plate 41 by adhesive joint. The island protrusions 56 are bonded to the piezoelectric elements 52 by adhesive joint. Further, the thick-walled parts 57 are bonded to the bracing parts 54 and the frame member 44 by the adhesive 50. Here, the vibrating plate 42 is formed by double-layer nickel electroforming. In this case, the thickness of the diaphragm part 55 is 3 μm and the width thereof is 35 μm (one side).

The nozzle plate 43 forms the nozzles 45 (FIG. 5) each having a diameter of 10–35 μm, for the respective pressurizing compartments 46. Also, the nozzle plate 43 is bonded to the channel plate 41 by adhesive joint. As for the nozzle plate 43, a metal such as stainless and nickel, a combination of a metal and a resin such as polyimide resin film, silicon, and a combination of these may be used. Here, the nozzle plate 43 is formed by such as a Ni plating film by using an electroforming method. In addition, the internal shape (inside shape) of the nozzle 45 is formed to be a horn shape (may also be a substantially cylinder shape or a substantially truncated cone shape). The hole diameter of the nozzle 45 is approximately 20–35 μm on the ink drop exit side. Further, the nozzle pitch of each row is 150 dpi.

Additionally, a water-repellent layer (not shown) on which surface treatment of water repellency is performed is provided on the nozzle surface (surface in the discharging direction: discharge surface) of the nozzle plate 43. As for the water-repellent layer, a water-repellent layer selected in accordance with the ink physicality is provided by such as PTFE-Ni eutectoid plating, and electrodeposition coating of fluorocarbon resin, deposition coating of fluorocarbon resin having evaporativity (for example, pitch fluoride), and baking of silicone resin/fluorocarbon resin after application of solvent, so as to stabilize the shapes and flying characteristics of ink drops and to obtain high grade image quality.

The piezoelectic element 52 is formed by alternately stacking a piezoelectric layer 61 of lead zirconate titanate (PZT) having a thickness of 10–50 μm/layer and an internal electrode layer 62 of silver/palladium (AgPd) having a thickness of several μm/layer. The internal electrode layers 62 are electrically connected to individual electrodes 63 and a common electrode 64 in an alternate manner that are end face electrodes (external electrodes) on the end faces. The pressurizing compartment 46 is contracted and expanded by expansion and contraction of the piezoelectric element 52 having the piezoelectric constant d33. When a driving signal is applied to the piezoelectric element 52 and charging is performed, the pressurizing compartment is expanded. On the other hand, when the piezoelectric element 52 is discharged, the pressurizing compartment is contracted to the opposite direction.

It should be noted that one of the end face electrodes of the piezoelectric element member is divided by half-cut dicing into the individual electrodes 63, and the other of the end face electrodes is not divided due to the limitation of a process such as notching and forms the common electrode 64 where continuity is made through all of the piezoelectric elements 52.

An FPC cable 65 is connected to the individual electrodes 63 of the piezoelectric element 52 by solder joint, ACF (anisotropic conductive film) attaching, or wire bonding, so as to apply the a driving signal. The FPC cable 65 is connected to a head drive circuit (driver IC) 71 for selectively applying a drive waveform to each piezoelectric element 52. Also, the common electrode 64 is connected to a ground (GND) electrode of the FPC cable 65 by providing an electrode layer at the end of the piezoelectric element 52.

In the inkjet head thus constructed, for example, by applying the drive waveform (a pulsed voltage of 10–50 V) to the piezoelectric elements 52 in accordance with a recording signal, deformation of the piezoelectric elements 52 in the stacking direction takes place. Thus, inks in the pressurizing compartments 46 are pressurized via the vibrating plate 42, and the pressure is increased. Accordingly, ink drops are discharged from the nozzles 45.

Thereafter, as the discharging of ink drops ends, ink pressure in the pressurizing compartments 46 is decreased, negative pressure is created in the pressurizing compartments 46 by the inertia of the flow of inks and discharging of the driving pulse, and the process proceeds to an ink filling process. On this occasion, inks supplied from ink tanks (not shown) flow in the common liquid compartment 48, flow from the common liquid compartment 48 to the fluid resistors 47 (FIGS. 5 and 7) via the ink supply openings 49, and the pressurizing compartments 46 are filled.

In addition, the fluid resistors 47 have the effect of attenuating residual pressure vibration after discharging, while serving as resistance in refilling by surface tension. By appropriately selecting the fluid resistance value of the fluid resistor 47, the balance between the attenuation of the residual pressure and refilling time is kept, and it is possible to reduce a time interval (driving frequency) until the process proceeds to the next ink drop discharging operation.

Figure 8:
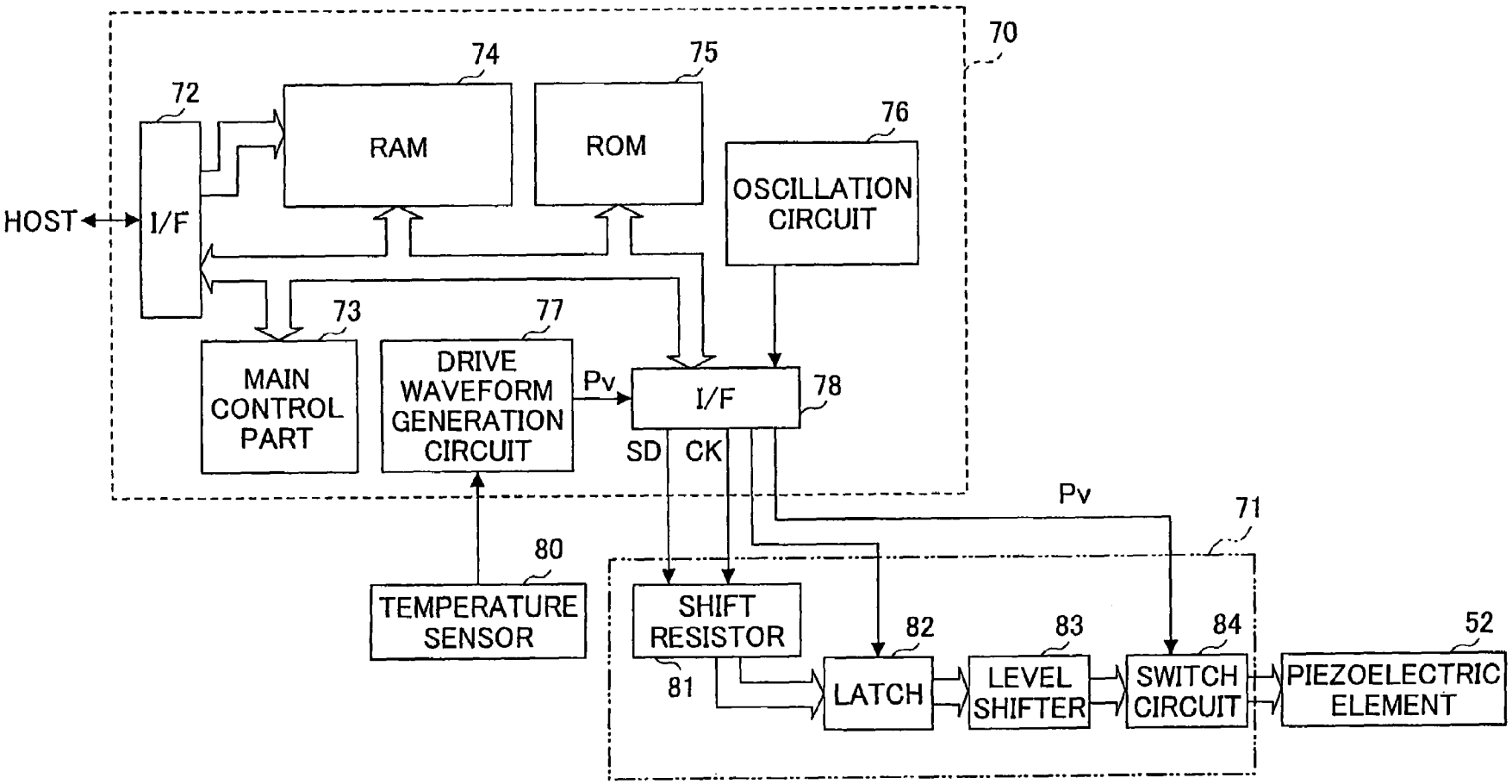
FIG. 8 is a block diagram for explaining the outline of a control part of the inkjet recording apparatus.

Next, referring to FIG. 8, a description will be given of an outline of a control part (head controller) of the inkjet recording apparatus.

The control part includes a printer controller 70 and an engine controller including the head drive circuit 71. The printer controller 70 includes an interface (hereinafter referred to as an "I/F") 72 that receives print data, for example, from a host computer, for example, via a cable or a network, a main control part 73 formed by a CPU, RAM 74, for example, that stores data and the like, ROM 75 that stores, for example, routines for data processing, an oscillation circuit 76, a drive waveform generation circuit 77 as drive waveform generating means generating a drive waveform Pv to the inkjet heads 14, an I/F 78 for transmitting, to the head drive circuit 71, such as print data converted into dot pattern data (bit map data) and the drive waveform, and a temperature sensor 80 that is temperature detecting means for detecting environmental temperature (detected temperature) T. Illustration of parts performing main scanning, sub-scanning, and drive control relating to a reliability maintaining/recovering mechanism is omitted.

The RAM 74 is used, for example, as various buffers and working memory. The ROM 75 stores various control routines carried out by the main control part 73, font data, graphic functions, types of procedures, for example. The main control part 73 reads the print data in a reception buffer included in the I/F 72 and converts the data into intermediate codes. The intermediate code data are stored in an intermediate buffer formed by a predetermined area in the RAM 74. The read intermediate code data are converted into dot pattern data by using font data stored in the ROM 75 and stored again in a different predetermined area in the RAM 74.

When the dot pattern data corresponding to one line of the recording heads 14 are obtained, the main control part 73 transmits the dot pattern data of one line in the form of serial data SD to the head drive circuit 71 via the I/F 78 in synchronization with a clock signal CK from the oscillation circuit 76.

The head drive circuit 71 is mounted on the driver IC and includes a shift resistor 81 receiving the clock signal CK and the serial data SD that are print signal, which are both supplied from the printer controller 70, a latch circuit 82 that latches a resist value of the shift resistor 81 by a latch signal LAT supplied from the printer controller 70, a level conversion circuit (level shifter) 83 that varies the level of the output value of the latch circuit 82, and an analog switch array (switch circuit) 84 of which ON/OFF is controlled by the level shifter 83. The switch circuit 84 receives the drive waveform PV supplied from the drive waveform generation circuit 77 of the printer controller 70 and is formed by a switch array. The switch circuit 84 is connected to the piezoelectric element 52 corresponding to each nozzle of the recording heads (inkjet heads) 14.

The print data SD serially transferred by the shift resistor 81 are temporarily latched by the latch circuit 82. The latched print data are pressurized to a voltage value at which the switch of the switch circuit 84 can be driven, for example, a predetermined voltage value on the order of several dozen volts, and then supplied to the switch circuit 84 as switching means.

The drive waveform Pv supplied from the drive waveform generation circuit 77 is applied to the input side of the switch circuit 84. The output side of the switch circuit 84 is connected to the piezoelectric element 52 as pressure creating means. Accordingly, for example, during a period when the print data given to the switch circuit 84 are "1", a drive pulse P obtained from the drive waveform Pv is applied to the piezoelectric element 52. The piezoelectric element 52 expands and contracts in accordance with the drive pulse P. On the other hand, during a period when the print data given to the switch circuit 84 are "0", the supply of the drive pulse P to the piezoelectric element 52 is suspended.

The drive waveform generation circuit 77 may be formed by a discrete circuit. However, here, the drive waveform generation circuit 77 includes a ROM storing pattern data of the drive waveform PV and a D/A converter performing D/A conversion on data of the drive waveform that is read out from the ROM. Moreover, here, the drive waveform generation circuit 77 stores in advance a plurality of drive waveform patterns corresponding to environmental temperatures, and the drive waveform to be output is selected according to environmental temperature (detected temperature) T detected by the temperature sensor 80.

A description will be given of embodiments of the head controller according to the present invention included in the inkjet recording apparatus constructed as described above.

First, referring to FIG. 9, a description will be given of a first embodiment of a head controller according to the present invention. In the first embodiment, an inkjet head provided with the piezoelectric element 52 having the piezoelectric constant d33 is driven by a pull discharging method to form ink drops.

Figure 9:
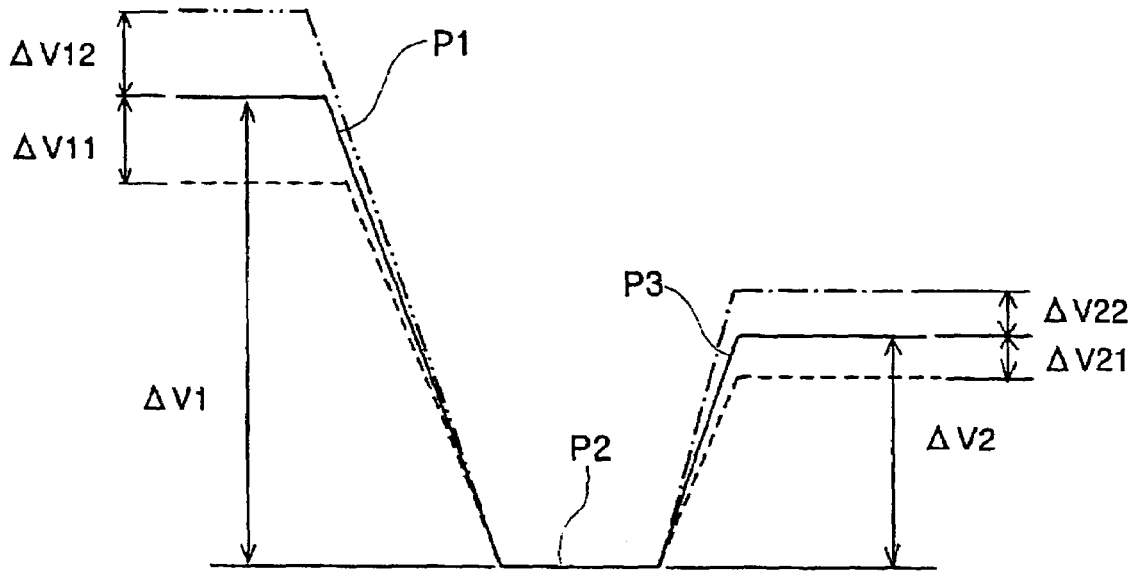
FIG. 9 is a graph of a drive waveform for explaining a first embodiment of a head controller according to the present invention.

As shown in FIG. 9, the drive waveform Pv (drive pulse P) used in this embodiment is a waveform that includes at least a first waveform element (first signal) P1 expanding the volume of the pressurizing compartment (pressure creation compartment) 46, a second waveform element (second signal) P2 maintaining the expanded state of the pressurizing compartment 46, and a third waveform element (third signal) P3 contracting the volume of the pressurizing compartment 46 in the expanded state so as to discharge ink drops.

In the drive waveform Pv, the potential difference between the first waveform element P1 at the beginning of the expansion of the volume of the pressurizing compartment 46 and the second waveform element P2 is taken as a first potential difference ΔV1, and the potential difference between the third waveform element P3 at the end of the contraction of the volume of the pressurizing compartment 46 and the second waveform element P2 is taken as a potential difference ΔV2.

Figure 10:
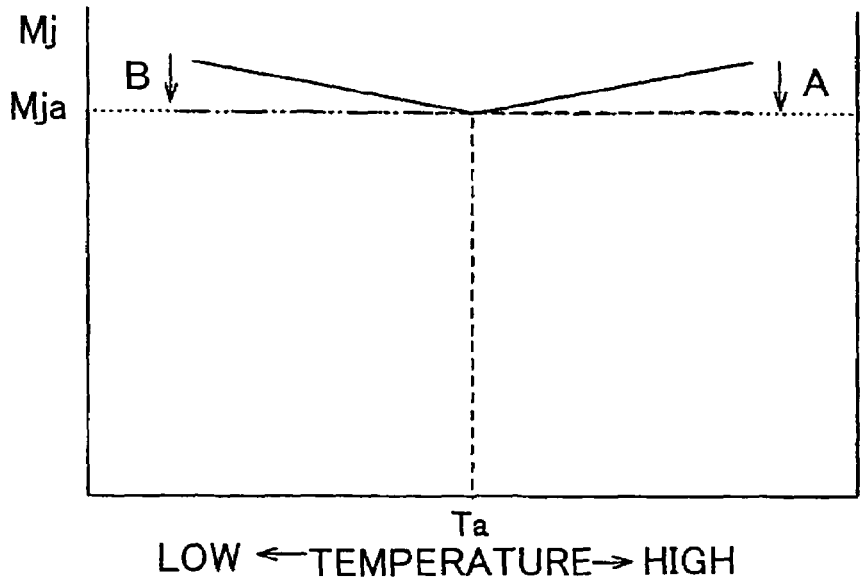
FIG. 10 is a graph for explaining variation in the ink drop discharging volume Mj with respect to temperature changes in the first embodiment of a head controller.

The viscosity of inks varies according to changes in environmental temperature. Thus, for example, in a case where an ink drop of a volume Mja is obtained at environmental temperature Ta when the drive waveform Pv indicated by the solid line in FIG. 9 is applied, the speed Vj of ink drops is increased as environmental temperature becomes higher, and the volume Mj of an ink drop is increased as indicated by the solid line in FIG. 10. On the other hand, as environmental temperature falls, the speed Vj of ink drops is decreased, and similarly, the volume Mj of an ink drop is increased.

Therefore, as indicated by the broken line in FIG. 9, according to environmental temperature changes, when environmental temperature is high, if the potential of the first waveform element P1 at the beginning of the expansion of the volume of the pressurizing compartment 46 and the potential of the third waveform element P3 at the end of the contraction of the volume of the pressurizing compartment 46 are decreased by ΔV11 and ΔV21, respectively, and ΔV11 and ΔV21 are set such that ΔV11>ΔV21 is satisfied, the difference between the first potential difference ΔV1 and the second potential difference ΔV2 is decreased.

In this manner, when environmental temperature is high, if the difference between the first potential difference ΔV1 and the second potential difference ΔV2 is narrowed (decreased) according to environmental temperature changes, discharge energy becomes small. Hence, referring to FIG. 10, it is possible to decrease the ink drop discharging speed Vj and reduce the ink drop discharging volume Mj in the direction indicated by an arrow A to the level as indicated by the broken line in FIG. 10.

In addition, as indicated by the two-dot chain line in FIG. 9, according to environmental temperature changes, when environmental temperature is low, if the potential of the first waveform element P1 at the beginning of the expansion of the volume of the pressurizing compartment 46 and the potential of the third waveform element P3 at the end of the contraction of the volume of the pressurizing compartment 46 are increased by ΔV12 and ΔV22, respectively, and ΔV12 and ΔV22 are set such that ΔV12>ΔV22 is satisfied, the difference between the first potential difference ΔV1 and the second potential difference ΔV2 is increased.

In this manner, when environmental temperature is low, according to environmental temperature changes, if the difference between the first potential difference ΔV1 and the second potential difference ΔV2 is widened (increased), it is possible to make the amount of meniscus the same as the amount of meniscus at ordinary temperature. Accordingly, referring to FIG. 10, it is possible to increase the ink drop discharging speed Vj and reduce the ink drop discharging volume Mj in the direction indicated by an arrow B to the level indicated by the two-dot chain line in FIG. 10.

Figure 11:
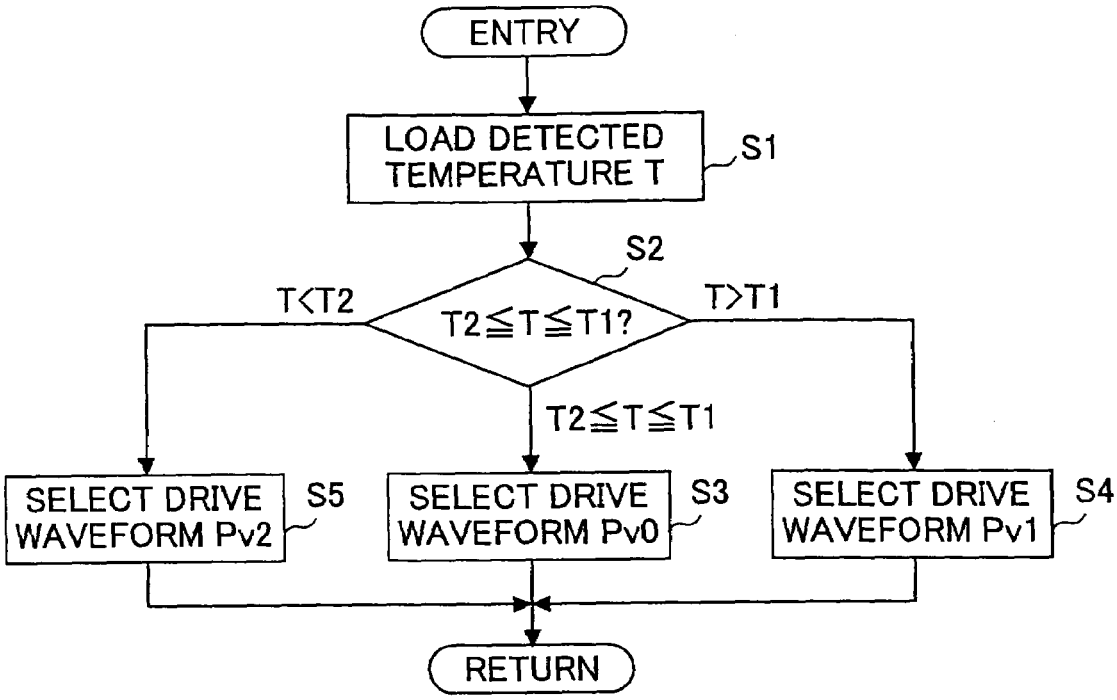
FIG. 11 is a flow chart for explaining the process in the first embodiment.

Thus, drive waveform patterns each including three kinds of waveform elements as shown in FIG. 9 (the solid line represents a drive waveform Pv0, the broken line represents a drive waveform Pv1, and the two-dot chain line represents a drive waveform Pv2) are stored in ROM of the drive waveform generation circuit 77 as the drive waveform pattern, for example. As shown in FIG. 11, the detected temperature T is loaded from the temperature sensor 80 in step S1. Then, in step S2, the detected temperature T is compared with a first predetermined temperature T1 and a second predetermined temperature T2. More specifically, it is determined whether or not T2≦T≦T1 is satisfied. When T2≦T≦T1 is satisfied, the drive waveform Pv0 is selected and output in step S3. When T>T1 (high temperature), the drive waveform Pv1 is selected and output in step S4. When T<T2 (low temperature), the drive waveform Pv2 is selected and output in step S5.

Hence, it is possible to reduce variation in ink drop discharging volume Mj caused by variation in the viscosity of inks due to temperature changes. Consequently, it is possible to control degradation of image quality.

Further, in the case above, the two kinds of temperatures (the predetermined first temperature T1 and the predetermined second temperature T2) are used for switching the drive waveform. However, by increasing the kinds of the drive waveform and the kinds of the predetermined temperature, it is possible to perform more fine control. In addition, it is possible to vary the potential of the drive waveform in a linear manner with respect to the detected temperature T. Additionally, in the above-described case, the plurality of kinds of drive waveform patterns are stored in advance and the drive waveform pattern to be output is selected in accordance with the detected temperature T. However, it is also possible to output a plurality of drive waveform patterns within one drive cycle (sequentially output the drive waveforms Pv0, Pv1, and Pv2 within one drive cycle, for example), and select the drive waveform pattern to be applied to the piezoelectric element by the switch circuit.

Next, referring to FIGS. 12 and 13, a description will be given of a second embodiment of a head controller.

In the second embodiment, the potential of the first waveform element P1 at the beginning of the expansion of the volume of the pressurizing compartment 46 is set higher than the potential of the third waveform element P3 at the end of the contraction of the volume of the pressurizing compartment 46. Also, the potential of the first waveform element P1 is varied in accordance with the detected result of environmental temperature, and the difference between the first potential difference ΔV1 and the second potential difference ΔV2 is varied.

Figure 13:
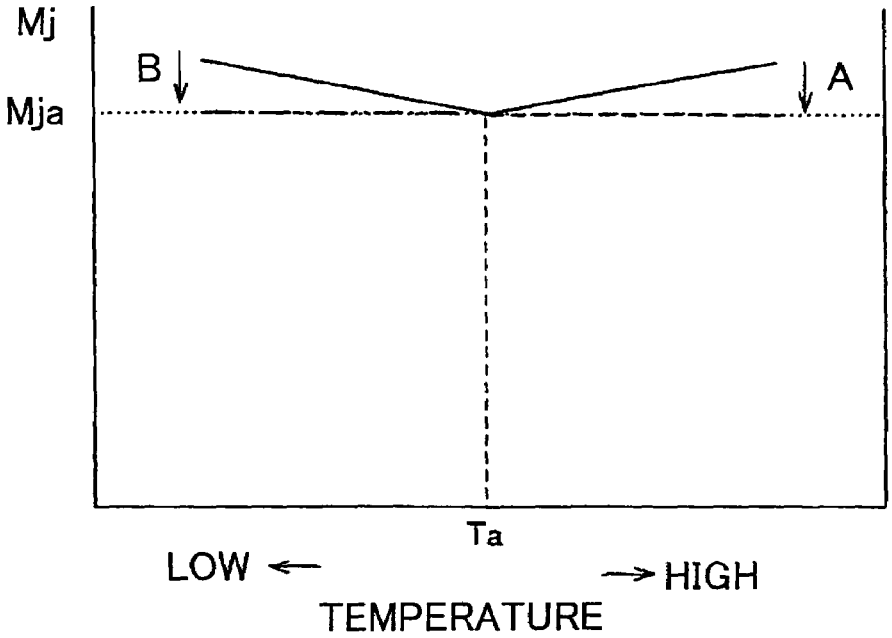
FIG. 13 is a graph for explaining variation in the ink drop discharging volume Mj with respect to temperature changes in the second embodiment of a head controller.

That is, in a case where the first potential difference ΔV1 is greater than the second potential difference ΔV2, the speed Vj of ink drops is increased, and the volume Mj of an ink drop is increased at high temperatures as shown in FIG. 13. On the other hand, at low temperatures, the speed Vj of ink drops is decreased, and the volume Mj of an ink drop is increased as shown in FIG. 13.

Figure 12:
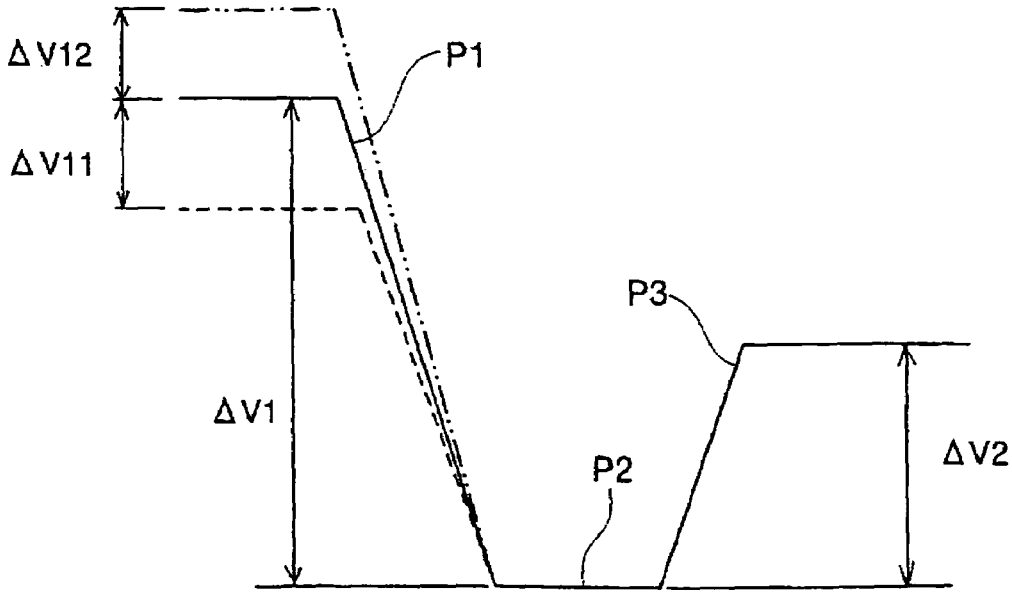
FIG. 12 is a graph of a drive waveform for explaining a second embodiment of a head controller according to the present invention.

Consequently, as in this embodiment, based on environmental temperature, when the potential of the first waveform element P1 is decreased as indicated by the broken line in FIG. 12, the first potential difference ΔV1 is reduced. If the potential of the third waveform element P3 is not varied, the difference between the first potential difference ΔV1 and the second potential difference ΔV2 is reduced. When the first potential difference ΔV1 is reduced in this manner, the discharge energy becomes small. Accordingly, it is possible to decrease the ink drop discharging speed Vj and reduce the ink drop discharging volume Mj in the direction indicated by an arrow A to the level indicated by the broken line in FIG. 13.

In addition, at low temperatures, if the potential of the first waveform element P1 is increased as indicated by the two-dot chain line in FIG. 12, the first potential difference ΔV1 is increased. Thus, if the potential of the third waveform element P3 is not varied, the difference between the first potential difference ΔV1 and the second potential difference ΔV2 is increased. When the first potential difference ΔV1 is increased as described above, it is possible to make the meniscus the same as the meniscus at ordinary temperature. As a result, it is possible to increase the ink drop discharging speed Vj and decrease the ink drop discharging volume Mj in the direction indicated by an arrow B to the level indicated by the two-dot chain line in FIG. 13.

Accordingly, in a case where the potential of the first waveform element P1 is higher than the potential of the third waveform element P3, the potential of the first waveform element P1 is varied so as to change the first potential difference ΔV1. Hence, it is possible to compensate for variation in the amount of ink drops caused by variation in the ink viscosity due to temperature changes. Thus, it is possible to improve image quality.

Next, referring to FIGS. 14 and 15, a description will be given of a third embodiment of a head controller.

In the third embodiment, the potential of the first waveform element P1 at the beginning of the expansion of the volume of the pressurizing compartment 46 is set lower than the potential of the third waveform element P3 at the end of the contraction of the volume of the pressurizing compartment 46. Also, the potential of the third waveform element P3 is varied in accordance with the detected result of environmental temperature, so as to change the difference between the first potential difference ΔV1 and the second potential difference ΔV2.

Figure 15:
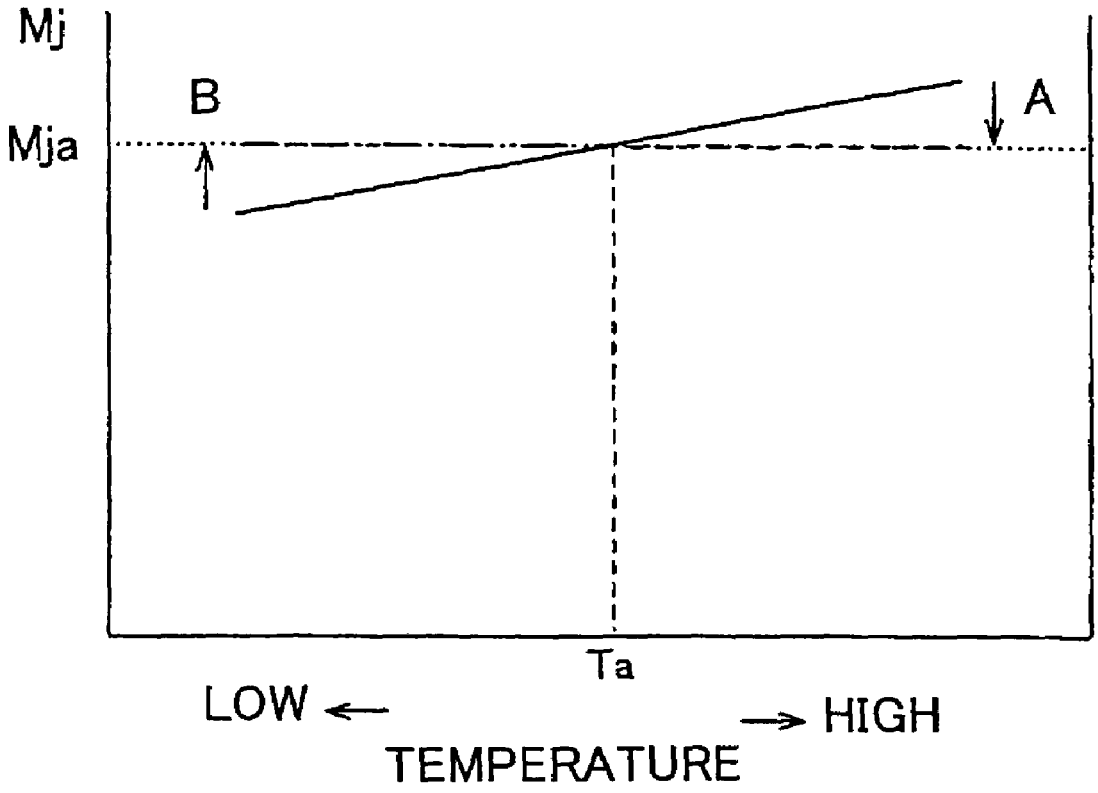
FIG. 15 is a graph for explaining variation in the ink drop discharging volume Mj with respect to temperature changes in the third embodiment a head controller.

That is, in a case where the second potential difference ΔV2 is greater than the first potential difference ΔV1, the speed of ink drops Vj is increased, and the ink drop discharging volume Mj is increased at high temperatures as shown in FIG. 15. On the other hand, at low temperatures, the ink drop discharging speed Vj is decreased, and the ink drop discharging volume Mj is decreased as shown in FIG. 15.

Figure 14:
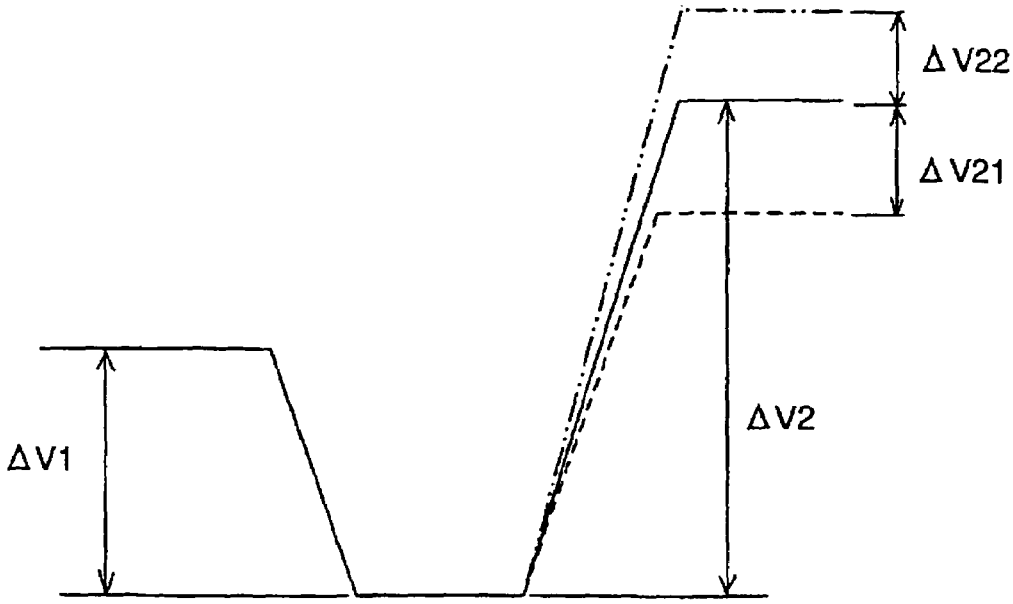
FIG. 14 is a graph of a drive waveform for explaining a third embodiment of a head controller according to the present invention.

Thus, as in this embodiment, based on environmental temperature, when the potential of the third waveform element P3 is decreased as indicated by the broken line in FIG. 14, the second potential difference ΔV2 is decreased. Hence, if the potential of the first waveform element P1 is not varied, the difference between the first potential difference ΔV1 and the second potential difference ΔV2 is decreased. When the second potential difference ΔV2 is decreased as described above, the discharge energy becomes small. As a result, it is possible to decrease the ink drop discharging speed Vj and reduce the ink drop discharging volume Mj in the direction indicated by an arrow A to the level indicated by the broken line in FIG. 15.

Additionally, at low temperatures, when the potential of the third waveform element P3 is increased as indicated by the two-dot chain line in FIG. 14, the second potential difference ΔV2 is increased. Thus, if the potential of the first waveform element P1 is not varied, the difference between the first potential difference ΔV1 and the second potential difference ΔV2 is increased. When the second potential difference ΔV2 is increased as described above, the discharge energy becomes great. Consequently, as shown in FIG. 15, it is possible to increase the ink drop discharging speed Vj and increase the ink drop discharging volume Mj in the direction indicated by an arrow B to the level indicated by the two-dot chain line in FIG. 15.

Accordingly, in a case where the potential of the third waveform element P3 is higher than the potential of the first waveform element P1, the potential of the third waveform element P3 is varied so as to change the second potential difference ΔV2. Hence, it is possible to compensate for variation in the amount of an ink drop caused by variation in the ink viscosity due to temperature changes. Thus, it is possible to improve image quality.

Additionally, in the above-described embodiments, though it is assumed that the piezoelectric element is PZT of d33 direction displacement, a flexible vibration type PZT may also be used. When PZT of d33 direction displacement is used, however, the element possesses higher reliability.

Further, the image recording apparatus according to the present invention is applied to the inkjet recording apparatus equipped with the droplet discharging heads that discharge ink drops. However, the present invention may also be applied to image recording apparatuses equipped with, for example, droplet discharging heads that discharge droplets of a liquid other than ink, for example, a liquid resist for patterning, and droplet discharging heads that discharge a genetic test sample.

As described above, with the head controller according to the present invention, when it is assumed that the potential difference between the first waveform element at the beginning of the expansion of the volume of the pressurizing compartment and the second waveform is the first potential difference, and the potential difference between the third waveform element at the end of the contraction of the volume of the pressurizing compartment and the second waveform element is the second potential difference, if environmental temperature is higher than the first predetermined temperature, the difference between the first and second potential differences is decreased. On the other hand, when environmental temperature is lower than the second predetermined temperature, the difference between the first and second potential differences is increased. Hence, it is possible to appropriately correct the drop speed and the drop volume with respect to temperature changes. Thus, it is possible to improve image quality.

Additionally, with the image recording apparatus according to the present invention, when it is assumed that the potential difference between the first waveform element at the beginning of the expansion of the volume of the pressurizing compartment and the second waveform is the first potential difference, and the potential difference between the third waveform element at the end of the contraction of the volume of the pressurizing compartment and the second waveform element is the second potential difference, if environmental temperature is higher than the first predetermined temperature, the difference between the first and second potential differences is decreased. On the other hand, when environmental temperature is lower than the second predetermined temperature, the difference between the first and second potential differences is increased. Hence, it is possible to appropriately correct the drop speed and the drop volume with respect to temperature changes. Thus, it is possible to improve image quality.

The present invention is not limited to the specifically disclosed embodiments, and variations and modifications may be made without departing from the scope of the present invention.

The invention claimed is:

1. A head controller for controlling pressure creating means for contracting and expanding a volume of a pressurizing compartment communicating with a nozzle of a droplet discharging head, comprising:

drive waveform generating means for outputting a drive pulse that includes at least a first waveform element for expanding the volume of said pressurizing compartment, a second waveform element for maintaining an expanded state of the volume of said pressurizing compartment caused by the first waveform element, and a third waveform element for contracting the volume of said pressurizing compartment in the expanded state so that droplets are discharged from said pressurizing compartment; and means for decreasing a difference between first and second potential differences when environmental temperature is higher than a first predetermined temperature and increasing the difference between the first and second potential differences when the environmental temperature is lower than a second predetermined temperature, wherein the first potential difference is a potential difference between the first waveform element at the beginning of expansion of the volume of said pressurizing compartment and the second waveform element, and the second potential difference is a potential difference between the third waveform element at the end of contraction of the volume of said pressurizing compartment and the second wave form element, and wherein the drive waveform generating means is configured to generate and output a drive waveform having the first potential difference greater than the second potential difference, and configured to vary a potential of the first waveform element according to the environmental temperature without varying a potential of the third waveform element.

2. The head controller of claim 1, wherein the potential of the first waveform element at the beginning of the expansion of the volume of the pressurizing compartment is set higher than the potential of the third waveform element at the end of the contraction of the volume of the pressurizing compartment.

3. An inkjet recording apparatus, comprising:

a droplet discharging head for discharging ink drops and having a pressurizing compartment;

drive waveform generating means for outputting a drive pulse that includes at least a first waveform element for expanding a volume of said pressurizing compartment of the droplet discharging head, a second waveform element for maintaining an expanded state of the volume of said pressurizing compartment caused by the first waveform element, and a third waveform element for contracting the volume of said pressurizing compartment in the expanded state so that ink drops are discharged from said pressurizing compartment;

temperature detecting means for detecting environmental temperature; and means for decreasing a difference between first and second potential differences when the environmental temperature is higher than a first predetermined temperature and increasing the difference between the first and second potential differences when the environmental temperature is lower than a second predetermined temperature, wherein the first potential difference is a potential difference between the first waveform element at the beginning of expansion of the volume of said pressurizing compartment and the second waveform element, and the second potential difference is a potential difference between the third waveform element at the end of contraction of the volume of said pressurizing compartment and the second waveform element, and wherein the drive waveform generating means is configured to generate and output a drive waveform having the first potential difference greater than the second potential difference, and configured to vary a potential of the first waveform element according to the environmental temperature without varying a potential of the third waveform element.

4. The inkjet recording apparatus of claim 3, wherein the potential of the first waveform element at the beginning of the expansion of the volume of the pressurizing compartment is set higher than the potential of the third waveform element at the end of the contraction of the volume of the pressurizing compartment.

5. An image recording apparatus, comprising:

a droplet discharging head for discharging droplets and having a pressurizing compartment;

drive waveform generating means for outputting a drive pulse that includes at least a first waveform element for expanding a volume of said pressurizing compartment of the droplet discharging head, a second waveform element for maintaining an expanded state of the volume of said pressurizing compartment caused by the first waveform element, and a third waveform element for contracting the volume of said pressurizing compartment in the expanded state so that droplets are discharged from said pressurizing compartment;

temperature detecting means for detecting environmental temperature; and means for decreasing a difference between first and second potential differences when the environmental temperature is higher than a first predetermined temperature and increasing the difference between the first and second potential differences when the environmental temperature is lower than a second predetermined temperature, wherein the first potential difference is a potential difference between the first waveform element at the beginning of expansion of the volume of said pressurizing compartment and the second waveform element, and the second potential difference is a potential difference between the third waveform element at the end of contraction of the volume of said pressurizing compartment and the second waveform element, and wherein the drive waveform generating means is configured to generate and output a drive waveform having the first potential difference greater than the second potential difference, and configured to vary a potential of the first waveform element according to the environmental temperature without varying a potential of the third waveform element.

6. The image recording apparatus of claim 5, wherein the potential of the first waveform element at the beginning of the expansion of the volume of the pressurizing compartment is set higher than the potential of the third waveform element at the end of the contraction of the volume of the pressurizing compartment.

* * * * *